United States Patent [19]

Leaver

[11] 4,064,595

[45] Dec. 27, 1977

[54] METAL DOOR AND HINGE CONSTRUCTION

[75] Inventor: John Y. McLeish Leaver, Quincy, Ill.

[73] Assignee: The Knapheide Manufacturing Co., Quincy, Ill.

[21] Appl. No.: 720,646

[22] Filed: Sept. 7, 1976

[51] Int. Cl.[2] ..... E05D 5/02; E05D 5/06

[52] U.S. Cl. ..... 16/128 R; 16/135; 16/162; 49/401

[58] Field of Search ..... 16/162, 135, 128 R, 16/137; 49/401

[56] References Cited

U.S. PATENT DOCUMENTS

| | | | |
|---|---|---|---|
| 1,785,362 | 12/1930 | Regan | 16/128 R |
| 3,171,157 | 3/1965 | Loughlin | 16/135 |
| 3,703,742 | 11/1972 | Konishi | 16/128 R |
| 3,710,416 | 1/1973 | Phelps | 16/135 |
| 3,881,220 | 5/1975 | Kiraly | 16/135 |

FOREIGN PATENT DOCUMENTS

| | | | |
|---|---|---|---|
| 624,710 | 8/1961 | Canada | 16/162 |
| 707,491 | 4/1931 | France | 16/128 R |

*Primary Examiner*—James Kee Chi

*Attorney, Agent, or Firm*—Lowe, Kokjer, Kircher, Wharton & Bowman

[57] ABSTRACT

A hinge construction particularly designed for exterior usage is provided by the present invention. Two planar sections are comprised of complementary land portions and cutaway portions disposed in spaced apart relationship along the length of the hinge. The cutaway portions of one section receive the land portions of the other section. With such configuration only a single thickness of metal separates the hinged member from the mounting member. First and second barrel mounting sections extend in the same direction outwardly away from the respective first and second planar sections. The two barrel mounting sections in turn mount complementary hinge barrels which, when positioned in alignment, receive a hinge pin. As a result of the hinge mounting sections projecting outwardly away from the hinged member and the mounting members, a weather shield is formed to help keep moisture and dirt out of the opening that is closed by the door. Location of the hinge barrels spaced from the hinged member and the mounting member also reduces the accumulation of dirt in the hinge.

4 Claims, 5 Drawing Figures

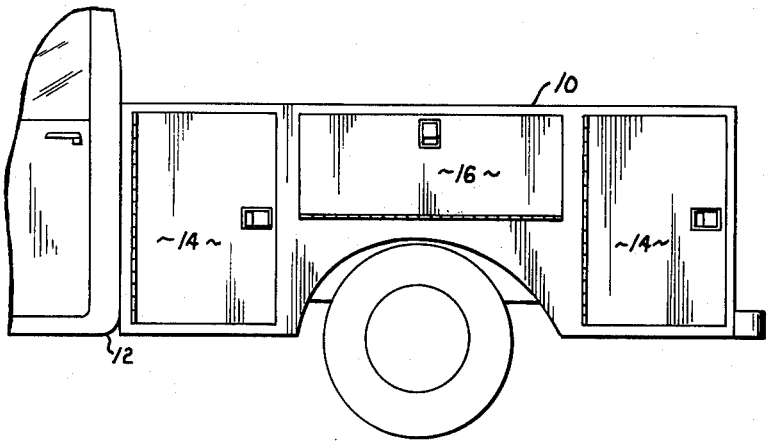
Fig. 1.
Fig. 2.
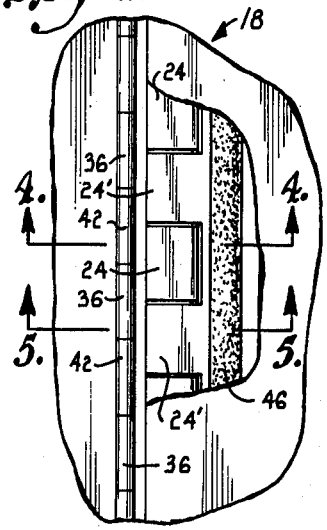
Fig. 3.
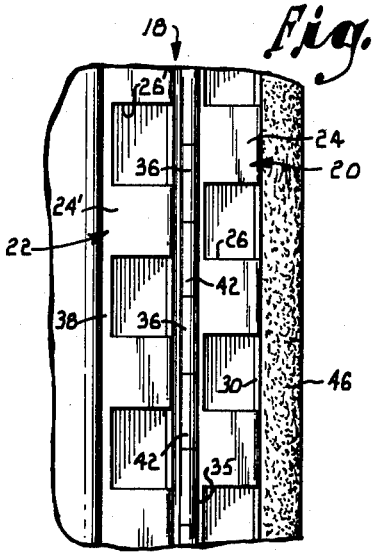
Fig. 4.
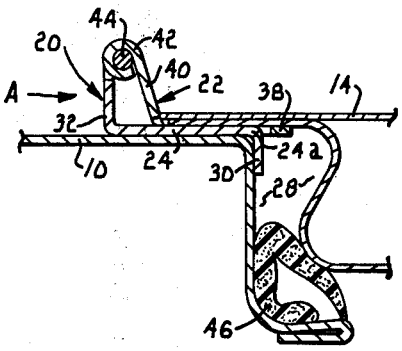
Fig. 5.
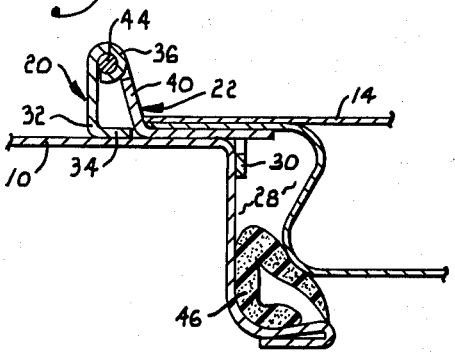

METAL DOOR AND HINGE CONSTRUCTION

This invention relates to hinge construction generally and, more particularly, to a hinge construction particularly adapted for use with utility truck body compartments.

The hinge construction for the compartments of utility truck bodies has long been a source of particular concern in the industry. Any installation of a hinged compartment on a truck body subjects the hinge to the movement of the vehicle which inherently imparts stresses into the compartment. Also, a hinge located on a truck bed body is exposed to all typed of weather as well as dirt, road asphalt, and other construction materials. Such a hinge construction must be both heavy duty and designed to minimize the entrance of dirt and moisture into the hinged compartment. Heretofore, it has sometimes been the policy to incorporate a weather shield alongside of a hinge for a utility body compartment so as to protect the hinge and also reduce the amount of moisture and dirt which may pass through the hinge into the compartment. While this construction has generally proved adequate, it is a primary objective of the present invention to provide a novel hinge construction which eliminates the need for a separate weather shield without sacrificing the protective functions of the weather shield.

Another important objective of the invention is to provide a hinge construction which permits interior placement of the hinge leaves but which separates the door from the body to which the door is mounted by only the thickness of a single hinge leaf.

As a corollary to the above object, it is an aim of this invention to provide a hinge construction as set forth which exceeds the strength of previous hinge constructions.

Still another object of my invention is to provide a novel hinge construction which locates the hinge barrels in spaced relationship from the body which supports the hinge thereby reducing the opportunity for dirt and other foreign material to accumulate in the hinge.

As a corollary to the above object, it is another one of the objectives of this invention to provide a hinge construction which is less subject to the build up of snow and ice but which is easier to clean if snow and ice build up does occur.

Still other objects of the invention will be made clear or become apparent from the following description and claims when read in light of the accompanying drawing, wherein:

FIG. 1 is a side elevational view of a utility truck body having both horizontally and vertically hinged doors for compartments in the body;

FIG. 2 is a fragmentary elevational view on a greatly enlarged scale of the hinge construction with the door removed to better illustrate details of the hinge;

FIG. 3 is another elevational view, similar to FIG. 2, but with the hinge leaves separated to show the hinge in an open position;

FIG. 4 is a horizontal cross sectional view looking in the direction of arrows 4—4 of FIG. 2; and FIG. 5 is a horizontal cross sectional view looking in the direction of arrows 5—5 of FIG. 2.

Referring initially to FIG. 1, a utility bed 10 is shown mounted on a truck chassis 12. Utility bed 10 is characterized by a plurality of compartments, two of which have vertically hinged doors 14 and one of which has a horizontally hinged door 16. Although the hinge construction for the vertically hinged doors 14 will be the only one described in detail, it is to be understood that the same hinge construction is utilized with horizontally mounted door 16.

Referring now to FIG. 3, the hinge construction of the present invention is designated generally by the numeral 18. Hinge 18 comprises two leaves formed from first and second planar sections designated generally by the numerals 20 and 22, respectively. Each planar section is in turn comprised of a plurality of spaced apart land portions 24, each of which is separated by a cutaway portion 26 of approximately the same area. It is to be noted that the land portions 24 on the first planar section 20 are arranged to be opposite cutaway portions 26' of second planar section 22. Similarly, land portions 24' on second planar section 22 are arranged to be opposite cutaway portions 26 on the first planar section. This arrangement permits the cutaway portions 26 to receive land portions 24' and cutaway portions 26' to receive land portions 24 when the hinge is in its closed position as illustrated in FIG. 2.

Referring now to FIGS. 4 and 5, the utility bed 10 is formed to present a compartment opening 28 which opening is closed by door 14. Each of the land portions 24 of planar section 20 has an integral extension 24*a* which projects at a right angle into the opening 28 and then merges into a first web portion 30 (see FIG. 3) which extends along the length of the hinge spanning the cutaway portions and interconnecting the land portions.

A first barrel mounting section 32 is integral wih a second web portion 34 (FIGS. 3 and 5) that extends along the length of the hinge interconnecting land portions 24 and spanning cutaway portions 26 in parallel relationship to first web portion 30. The barrel mounting section 32 presents a right angle with web portion 34 and extends outwardly to mount a plurality of first hinge barrels 36.

With particular reference to FIG. 3, it is seen that the land portions 24' of second planar section 22 are interconnected by a third web portion 38 that extends along the length of the hinge spanning the second cutaway portions 26'. Integral with the land portions 24' and interconnecting them along their sides opposite web portion 38 is a second barrel mounting section 40 which is integral with land portions 24' and extends upwardly and outwardly therefrom at an acute angle. Barrel mounting section 40 has secured to its outermost edge a plurality of second hinge barrels 42. Manifestly, the hinge barrels 42 are spaced apart by a distance equal to the length of hinge barrels 36 and are disposed in offset relationship to the latter hinge barrels so that both sets may be complementally received into alignment, thereby permitting insertion of a single hinge pin 44.

Referring to FIG. 4, it is seen that a flexible weather seal 46 is provided within compartment opening 28 at a lip formed in the body 10 to assure a moisture-tight and dust-tight compartment. First planar section 20 is secured to the bed 10 preferably through a series of spot welds along land portions 24. Similarly, planar section 22 is secured to door 14 by a series of spot welds along land portions 24'. It will be appreciated that by virtue of the complementary relationship between the land portions and the cutaway portions of the two planar sections whereby one is received by the other when the door is in its closed position, the total distance between the door and the bed when the door is closed is the thickness of only one hinge leaf, as represented by land portion 24 in FIG. 4.

The two barrel mounting sections 32 and 40 which extend outwardly away from the truck bed and door provide a weather shield that helps to prevent moisture and dirt traveling in the direction of arrow A in FIG. 4 from entering the compartment. This eliminates the need for a separate weather shield adjacent the hinge as has heretofore been required with some prior hinge constructions.

Another advantage of the above-described hinge construction is that with the hinge barrels and point of pivot located in spaced relationship to the bed 10, there is less opportunity for dirt and other foreign material to accumulate in the hinge. This position for the hinge barrels also reduces the opportunity for ice and snow to accumulate in the hinge, making it inoperable. If in extreme weather conditions ice and snow does build up to a point where cleaning is required, this may be done much more readily by virtue of the location of the hinge barrels away from the bed than is possible with some prior art hinge constructions.

Another advantage of the hinge construction of the present invention, which is recognized when the hinge is utilized to mount a horizontally hinged door, such as 16, is that the location of the hinge point spaced away from the bed 10 facilitates closing of the door. This is attributable to the fact that with the hinge point in spaced relationship to the bed, as the horizontally hinged door 16 is lifted the center of gravity of the door weight is transferred from a point outside of the hinge pin 44 to a point inside of the latter before the door is fully closed. Thus as the door is lifted and moved to a point where the center of gravity of the door is inside of the hinge pin, the weight of the door will tend to pull it closed and latched, thereby assuring that it will be positively shut without the necessity for slamming or repeated closings.

Having thus described the invention, I claim:

1. Combination hinge and weather shield construction for use in securing a door to a body, the latter presenting an opening to be closed by the door, and in preventing moisture and dirt from entering the opening, said construction comprising:

a first planar section adapted to be secured to said body outside of said opening and extending along the body for a distance in a direction away from said opening, said first section being characterized by a plurality of first land portions along its length;

a first barrel mounting section extending transversely away from the body and being coupled with said first planar section at the end of the latter removed from said opening;

a plurality of first hinge barrels disposed in spaced apart relationship along said first barrel mounting section;

a second planar section adapted to be secured to said door and extending outside of said opening along the body for a distance in a direction away from said opening, said second section being characterized by a plurality of second cutaway portions separated by a plurality of second land portions, both of said second cutaway and land portions extending along said body, said second cutaway portions and said second land portions being complemental to said first cutaway portions and said first land portions whereby said cutaway portions on one section receive the land portions of the other section;

a second barrel mounting section extending transversely away from the door and being coupled with said second planar section at the end of the latter removed from said opening;

a plurality of second hinge barrels disposed in spaced apart relationship along said second barrel mounting section; and a hinge pin received by said first and second hinge barrels.

2. Hinge construction as set forth in claim 1, wherein each of said first land portions extends into said opening and all of said first land portions are interconnecting by a common first web portion spanning said first cutaway portions.

3. Hinge construction as set forth in claim 2, wherein is provided a second web portion extending parallel to said first web portion and interconnecting said first land portions at the opposite sides of the latter from said first web portion.

4. Hinge construction as set forth in claim 3, wherein is included a third web portion interconnecting said second land portions and spanning said second cutaway portions.

* * * * *